United States Patent [19]

Smith

[11] Patent Number: 4,860,666

[45] Date of Patent: Aug. 29, 1989

[54] MULTI-AXLE, STEERED ARTICULATED RAILWAY VEHICLE WITH COMPENSATION FOR TRANSITIONAL SPIRALS

[75] Inventor: Roy E. Smith, Kingston, Canada

[73] Assignee: UTDC Inc., Kingston, Canada

[21] Appl. No.: 157,565

[22] Filed: Feb. 19, 1988

[51] Int. Cl.[4] ..... B61F 5/38

[52] U.S. Cl. ..... 105/168; 105/183

[58] Field of Search ..... 105/165, 167, 168, 183

[56] References Cited

U.S. PATENT DOCUMENTS

| | | | |
|---|---|---|---|
| 1,232,918 | 7/1917 | Head | 105/165 |
| 2,071,207 | 2/1937 | Knecht | 105/165 |
| 3,696,757 | 10/1972 | Newman et al. | 105/168 X |
| 4,285,280 | 8/1981 | Smith | 105/168 |
| 4,289,075 | 9/1981 | Smith | 105/168 X |

FOREIGN PATENT DOCUMENTS

| | | | |
|---|---|---|---|
| 1083886 | 8/1980 | Canada . | |
| 1115126 | 12/1981 | Canada . | |
| 2854776 | 7/1980 | Fed. Rep. of Germany | 105/168 |
| 390036 | 3/1933 | United Kingdom | 105/165 |
| 2024129 | 1/1980 | United Kingdom | 105/165 |

*Primary Examiner*—Andres Kashnikow

*Attorney, Agent, or Firm*—Rogers, Bereskin & Parr

[57] ABSTRACT

An articulated vehicle has two body portions which are pivotally connected and supported on a frame. First and second wheelsets are pivotally mounted to and support the frame. The third and fourth wheelsets are provided for supporting the other ends of the first and second body portions, remote from the frame. A steering arrangement comprising a detecting device and a guiding device are provided, which can be in the form of a mechanical linkage. The first detecting device detects changes in the angle between the frame and the first body portion, while a second detecting device detects changes in the angle between the frame and the second body portion. Corresponding first and second guide devices respond to the detected angles; the first guide device guides the first and third wheelsets to radial alignment, while the second guide device guides the second and fourth wheelsets to a radial alignment.

8 Claims, 4 Drawing Sheets

MULTI-AXLE, STEERED ARTICULATED RAILWAY VEHICLE WITH COMPENSATION FOR TRANSITIONAL SPIRALS

This invention relates to railway equipment and in particular relates to an improved railway vehicle having wheelsets which are guided to a radial configuration when the vehicle is travelling on curved track.

It has long been understood in the railroad art that it is desirable that wheelsets move to alignment with the radius of curvature when travelling on curved track. Single wheelsets which are pivotally mounted to support structure will freely move to a radial configuration when travelling on curved track and to a position perpendicular to the direction of travel when travelling on straight track. It has long been understood by those familiar with the railroad art that single wheelsets having conical wheels, however, are not stable and will hunt back and forth on either side of the desired alignment Various mechanisms have been provided to guide single wheelsets to a radial configuration.

In Canadian Patent No. 1,115,126 entitled Articulated Railway Vehicle Carried on Radial Single Wheelsets issued Dec. 29, 1981 and assigned to the assignee of this invention, a mechanism has been illustrated for utilizing the angle between articulated car bodies to move single wheelsets to a radial configuration. While mechanisms of the type taught in the aforementioned patent are useful, there is room for an improved mechanism which would more accurately guide the wheelsets to the radial position.

The theoretical basis of the aforementioned patent is that the angle between body portions of an articulated rail vehicle is directly related to the radius of curvature. Thus, changes in the angle may be used to guide the wheelsets to the radial configuration. This analysis is correct when all wheelsets of the articulated vehicle are travelling on a track of constant radius. However, errors occur if there is a different radius of curvature in place for one or more of the wheelsets. In building most railroad systems tangent track is not joined directly to track of uniform radius of curvature. Even in these situations, structures of the kind taught in Canadian Patent No. 1,115,126 (Single Axle) will not give accurate alignment of the axles when a portion of the vehicle is on tangent track and a portion is on track of constant radius. In most railroad systems, tangent track is interconnected to track of constant radius by a transitional section. Transitional section track has a varying radius of curvature. Vehicles manufactured in accordance with the teachings of the aforesaid patent will experience alignment errors when entering transition track and while travelling on transition track. Often these errors are small and unimportant. However, if the wheelset spacing over which the steering input must operate is long compared with the curve radii and transition length, such errors can be significant enough to cause squeal noise. The present invention provides a mechanism which gives considerably more accurate steering of the wheelsets while travelling on transitional track and provides equally accurate steering of the wheelsets when travelling on track of constant radius of curvature.

According to the invention, an articulated vehicle comprises two body portions and a frame which is pivotally affixed to and supports ends of the two body portions. First and second wheelsets are pivotally affixed to and support the frame. A third wheelset is provided for supporting the first body portion remote from the frame, while a fourth wheelset is provided for supporting the second body portion remote from the frame. According to the invention a steering means is provided for steering all of the four wheelsets to a substantially radial alignment when the vehicle is travelling on curved track. The steering means comprises detecting means and guiding means. A first detecting means detects changes in the angle between the frame and the first body portion. First guide means are responsive to the first detecting means. These guide means guide the first and third wheelsets to the radial alignment. Second detecting means detect changes in the angle between the frame and the second body portion. Second guide means are responsive to the second detecting means. These guide means guide the second and fourth wheelsets to the radial alignment.

The vehicle steering means comprising both the detecting and guiding means, may be hydraulic in nature, electrical in nature or comprise a series of mechanical links or mechanisms. The detecting means and guiding means may be separate structural items or unitary structural items which perform both functions.

The invention will be more clearly understood with reference to the accompanying drawings which illustrate a preferred embodiment of the invention, and in which.

Figure 1:
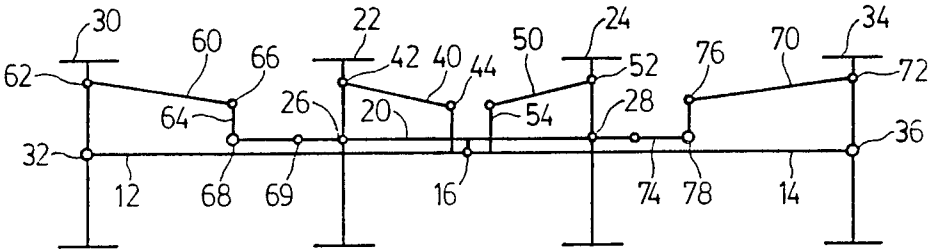
FIG. 1 is a schematic diagram of an articulated vehicle in accordance with the invention when travelling on straight or tangent track.

The vehicle is illustrated generally schematically by the numeral 10. The vehicle comprises a first body portion 12 and a second body portion 14. Body portions 12 and 14 are articulated about an articulation joint 16.

The articulation joint 16 is supported upon a frame 20. The frame 20 is pivotally affixed to the articulation joint 16 for pivotal movement about the axis of articulation. The frame 20 is supported by a first wheelset 22 and a second wheelset 24. Wheelsets 22 and 24 support the frame 20 for respective pivotal motion about axis 26 and 28 respectively.

The first body portion 12 is supported by a third wheelset 30. Wheelset 30 supports the first body portion 12 remote from the articulation joint 16 for movement about a pivotal axis 32. A fourth wheelset 34 supports second body portion 14 remote from articulation joint 16 for movement about a pivotal axis 36.

The pivotal axes 26, 28, 32 and 36 for the wheelsets 22, 24, 30 and 34 respectively may be an actual pivotal connection or a virtual pivotal axis. The precise manner of pivotal connection is not restricted by the mechanism according to this invention. The wheelsets may support the load of the vehicle through bolsters with pivotal connection, bolsters resting on sliding pads or by using frame members mounted in elastomeric members aligned for motion in sheer to provide the virtual pivotal connections. The designer is free to use any form of typical railroad wheelset suspension system while still utilizing the structure of this invention.

One of the structures which may be utilized in connection with the structure of this invention is that shown in applicant's prior Canadian patent Nos. 1,115,126 entitled Articulated Railway Vehicle Carried on Radial Single Wheelsets issued Dec. 29, 1981 and 1,083,886 entitled Radial Truck for Railway Vehicle issued Aug. 19, 1980.

The main structural load of the railroad vehicle and contents is supported by the four wheelsets. The first and second wheelsets 22 and 24 support the frame 20 which in turn supports the articulation joint 16. The two portions of the car body 12 and 14 are respectively supported on wheelsets 30 and 34. These structures must be made of sufficient strength to carry the loads for which the vehicle is designed.

Figure 2:
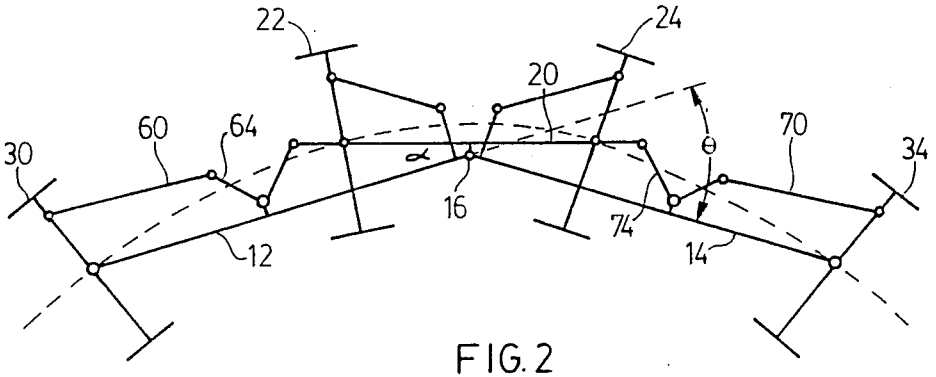
FIG. 2, illustrates the vehicle of FIG. 1 when travelling on curved track of constant radius.
Figure 3:
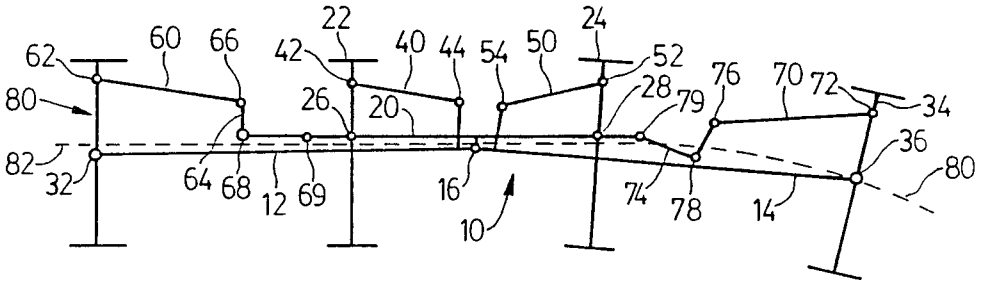
FIG. 3 illustrates the vehicle of FIG. 1 when entering a section of transition track.

From reference to FIGS. 1, 2 and 3 it will be noted that as the vehicle enters curved track, (i.e. moving to the right in FIG. 3) an angle develops between the vehicle body portion 14 and the frame 20. As the vehicle proceeds along the transitional track and finally on to track of constant radius, an angle also develops between car body portion 12 and the frame 20. The angle between the particular car body portion and the frame 20 is related to the apparent radius of curvature for the section of track upon which the car body portion is then located. The mechanism of this invention detects the changes in these angles and guides the wheelsets to a substantially radial position based upon the included angle between the frame 20 and the car body portions 12 and 14.

Various means may be used to detect the developing angle between the car body portions and the frame 20. In FIGS. 1, 2 and 3 a typical mechanical linkage has been shown. The mechanical linkage both detects and guides each of the wheelsets to an appropriate alignment.

In this disclosure and in the claims, special meanings have been attributed to the phrases "pivotally connected" and "pivotally linked". The term "pivotally connected" is used to indicate two structures which are fixed together for relative pivotal movement about a single pivotal axis. The term "pivotally linked" is used to indicate that the structures are able to move with relative pivotal motion, but the movement may be about a single pivotal connection or a multiple pivotal connection having two or more pivotal axes.

A first link 40 is pivotally connected to first wheelset 22 for movement about a pivotal axis 42. The first link 40 is also pivotally connected to the first car body portion 12 for movement about a pivotal axis 44. Pivotal axis 44 is on a lateral extension from the central axis of first body portion 12.

A second link 50 is pivotally connected to second wheelset 24 for movement about a pivotal axis 52. The second link 50 is also pivotally connected to the second car body portion 14 for movement about a pivotal axis 54. Pivotal axis 54 is on a lateral extension from the central axis of second car body portion 14.

A third link 60 is pivotally connected to the third wheelset 30 for movement about pivotal axis 62. The third link 60 is pivotally linked to first car body portion 12 and pivotally linked to frame 20. The pivotal linking comprises a bell crank 64 having a pivotal connection to each of the third link 60, the first car body portion 12 and the frame 20 at pivotal axes 66, 68 and 69 respectively.

A fourth link 70 is pivotally connected to the fourth wheelset 34 for movement about pivotal axis 72. The fourth link 70 is pivotally linked to second car body portion 14 and pivotally linked to frame 20. The pivotal linking comprises a bell crank 74 having a pivotal connection to each of the fourth link 70, the second car body portion 14 and the frame 20 at pivotal axes 76, 78 and 79 respectively.

FIG. 1 shows the vehicle travelling on tangent track. As required by the geometry, all of the wheelsets are perpendicular to the tangent track and, of course, parallel one to the other. In FIG. 2 the vehicle is shown travelling on curved track of constant radius. All of the wheelsets are parallel to a radius of curvature and thus no sliding occurs. As shown in FIG. 2 there is developed an angle alpha $\alpha$ between the frame 20 and the first car body portion 12. For a vehicle which is symmetrical about the articulation joint 16 there will also be an angle alpha $\alpha$ between the second car body portion 14 and the frame 20. The frame 20 lies on the bisector of the angle $\theta$ between first and second car body portions 12 and 14 respectively. The geometry of all of the steering mechanism components is such as to make all wheelsets radial to the circular arc when the vehicle is on track of constant radius.

FIG. 3 illustrates the function of the linkage upon entering a transition zone. In this Figure, wheelset 34, the leading wheelset, has just entered the curved section of track 80 and wheelsets 24, 22 and 30 are still on the tangent section 82. Wheelset 34 has moved laterally with respect to body portion 12. At this point, wheelset 34 and wheelset 24 will each receive steering inputs, wheelset 34 being required to move considerably more than wheelset 24 due to the differing geometry for the two wheelsets. At this moment both inputs will be proportional to the angle between the car body sections 12 and 14. In general, the steering inputs depend on the angles between the frame 20 and each of the car bodies 12, 14; at the entry to a curve, as the frame 20 is aligned with the rear car body 12, then one can consider the angle between the bodies 12, 14 as controlling steering of the two lead wheelsets 23, 24. As the vehicle proceeds further into the curve, wheelset 24 will begin to move laterally relative to wheelsets 22 and 30, which are still on tangent track, and thus frame 20 will begin to turn relative to car body sections 12 and 14. This will have the effect of reducing the proportion of the inter-body angle which drives the steering of wheelsets 34 and 24 and will begin to generate a steering input to wheelsets 22 and 30. As the vehicle moves further and further into the curve this process of increasing the steering effect on the trailing pair of wheelsets and decreasing it on the leading pair of wheelsets will continue until, when fully established on a constant radius curve, as shown in FIG. 2, each wheelset will receive a steering input proportional to the angle $\alpha$ between one of the car body sections and the frame 20 which is half the angle $\theta$ between the car body sections 12 and 14. As shown in FIG. 2, the mechanism is arranged to give true radial steering on any fully established curve radius with half the inter car body angle as the input signal.

On entering the transition, twice this signal ratio will be obtained by the present mechanism which is then gradually reduced to the correct amount as the vehicle moves further into the spiral, only achieving equal steering effect on all axles when fully established on track of constant radius.

The structure by which this type of steering can be obtained is not limited to the structure shown in the schematic FIGS. 1 through 3. These Figures are intended to illustrate the principle of the invention.

An embodiment which would be attractive in many instances would be for the centre assembly consisting of frame 20 and wheelsets 22 and 24 and associated links to be replaced by a truck similar to that shown in our previous U.S. Pat. No. 4,285,280 issued Aug. 25, 1981. Various other linkages would be possible to achieve the same steering effect.

Those familiar with pivotal connections in the railroad art will recognize that the usual practice is to induce a certain degree of resilience in each pivotal connection. The resilience which is typically introduced into pivotal connections of the type common in railroad practice are appropriate for use with the linkages of the present invention. It is important that there be a certain resilience in the guiding mechanism in order to satisfy dynamic considerations of wheelset behaviour, a factor which is commonly understood in the railroad art. The resilience typically involved in such connections will also be necessary with the linkage of the present invention in order to permit the degree of freedom required for movement for the linkages. Those skilled in the art of dealing with mechanical linkages will appreciate that there must be some resilience in the various pivotal connections such as between bell crank members 64 and 74 and their respective pivotal connections. This is a multilink structure and thus would not permit appropriate relative movement of the links which would be required to accommodate the geometrical alignment shown in FIG. 2. In order to enable the mechanism to arrive at the alignment shown in FIG. 2, sufficient resilience is included in all of the pivotal connections. An alternative is to include an additional link, for example, between bell cranks 64 and 74 and their pivotal connections 69 and 79 respectively. An additional link of short length inserted in the mechanism at that point would permit the linkage to move to the desired alignment without the need of any resilience in the mechanism itself. However, as resilience is desirably included within the mechanism for stability purposes, we believe that an additional link is not necessary for most practical purposes.

Figure 5:
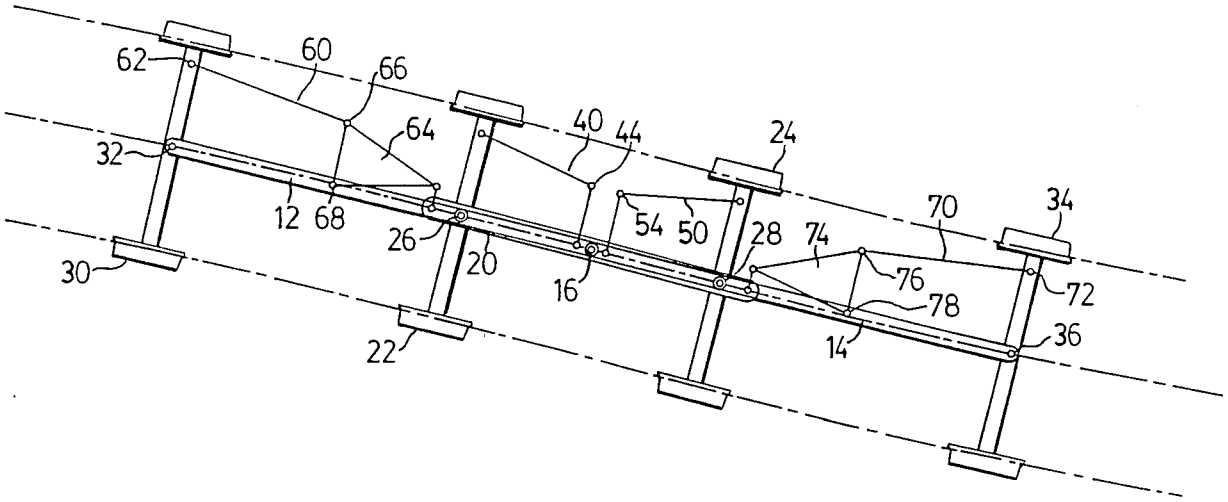
FIG. 5 is a computer diagram illustrating the alignment of the mechanism of the invention in an "S" curve.

In computer diagram analyses of the linkage as illustrated in FIGS. 1, 2 and 3, various curve profiles were verified to determine the error which would occur in curves of varying descriptions. One of the most difficult situations to handle in typical railroad layouts is that known to those in the railroad art as a number four turnout cross over. This occurs when the vehicle moves from one track to the next adjacent track through what is basically an "S" curve comprising transitions both into and out of the cross-over. With the mechanism as illustrated in FIGS. 1 through 3 hereof but including an additional link with the bell cranks in place of built in resilience, substantial alignment of all four wheelsets was achieved. Wheelsets 22 and 24 were in the order of only 28 minutes in error from the radial alignment. Wheelsets 30 and 34 were within 57 minutes of the desired alignment. A computer generated diagram illustrating this mechanism and these errors is illustrated in FIG. 5. In less severe situations involving a vehicle entering a single number four turn out, with wheelset 22 just commencing into the turnout, alignment errors of 24 minutes or less were shown. Alignment errors occurring on track of constant radius of 18 meters were of the order of four minutes or less.

Figure 4:
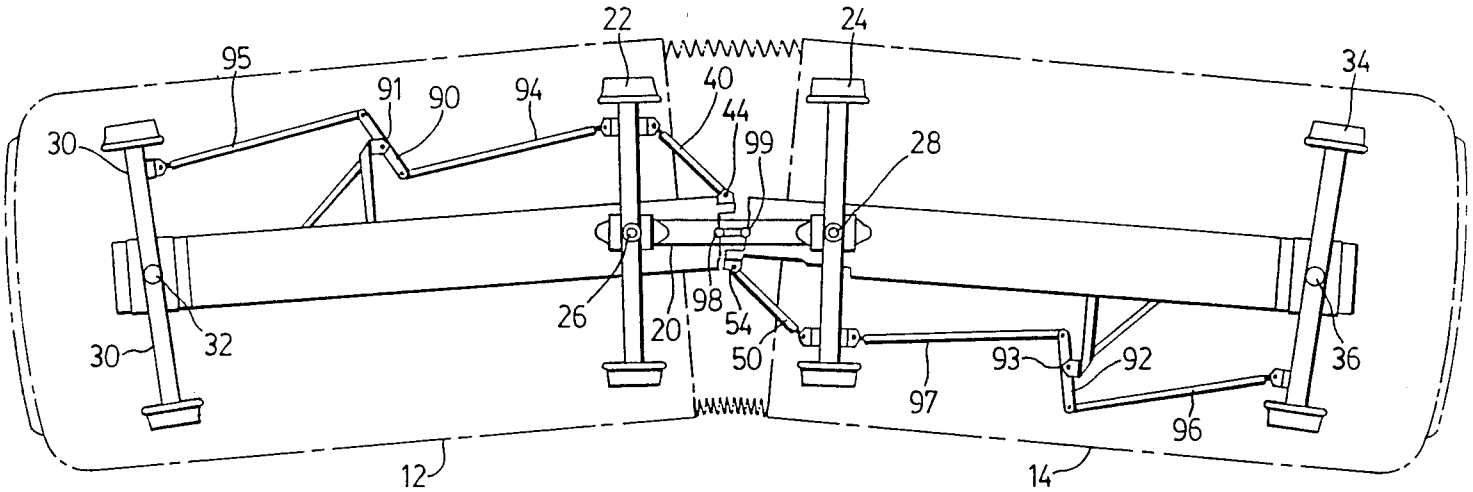
FIG. 4 illustrates a practical embodiment having an alternate mechanism which is equivalent to the mechanism illustrated schematically in FIG. 1.

FIG. 4 shows a varient of the invention. Here like parts have been given the same references as in FIGS. 1, 2 and 3. The car body 12 and 14 are supported on the truck frame 20 about closely adjacent articulation axes 98 and 99. The spacing of these axes is not sufficient to affect the analysis set out above.

In FIG. 4, the bell cranks 64, 74 have been replaced by straight bell cranks 90, 92, each of which is pivotally mounted intermediate its ends at 91 and 93 respectively to the respective car body 12, 14.

With respect to bell crank 90 the link 95 which corresponds to link 60 is pivotally connected to the bell crank 90 and wheelset 30. A further link 94 is pivotally connected to the other end of the bell crank 90 and pivotally connected to wheelset 22. Each of links 94 and 40 may conveniently be attached to a bearing block or the like on wheelset 22.

This mechanism is repeated with respect to car body 14 with link 96 corresponding to link 95. There is also another further link 97 corresponding to link 94. In FIG. 4 the wheelsets 22 and 24 having steering connections which are similar to those shown in FIG. 1. The links 40 and 50 are pivotally connected to the car bodies 12 and 14 respectively at pivotal connections 44 and 54 respectively.

In FIG. 4 the mechanism is shown as being on the opposite side of the longitudinal axis of the car body 14 as compared to FIG. 1. However, this does not alter the functioning of the mechanism.

In the mechanism illustrated in FIGS. 1–3 the inner wheelsets 22 and 24 are guided into alignment by a mechanism which senses the angle between the truck frame 20 and the respective car body 12 and 14. Also in that arrangement, the outer wheelsets 30 and 34, are guided into alignment by a separate mechanism which also senses the angle between the truck frame 20 and the corresponding respective car body 12 and 14. In the embodiment of FIG. 4 the inner wheelsets 22 and 24 are aligned by a mechanism sensing the angle between the truck frame 20 (the structural element to which the two wheelsets 22 and 24 are pivoted) and the corresponding respective car body 12 and 14. The outer wheelsets 30 and 34 are aligned by connection, through a series of links, to the inner wheelsets. Because the inner wheelsets are guided by the angle between the two frame elements (namely the truck frame 20 and the appropriate car body 12 and 14), if the geometrical relationships are maintained by suitable proportioning of the links, this is a direct equivalent of the mechanism of FIG. 1 which uses an entirely separate linkage system to guide each outer wheelset from the angle between the truck frame 20 and the respective car body frame.

In each of the embodiments the wheelsets are steered by determining the angle between the truck frame and the car body associated with the wheelset. In the embodiment of FIG. 4 wheelset 30 is pivotally connected to and supports car body 12. The steering links, 95, 90 and 94 provide pivotal linkage to car body 12 and to wheelset 22. Wheelset 22 is pivotally connected to and supports truck frame 20. Wheelset 22 is pivotally linked to car body 12 by link 40. Accordingly, the linkage shown in FIG. 4 makes use of the same angular relations to arrange for steering of the wheelsets.

While the invention has been described and illustrated with respect to mechanical linkages, it will be appreciated that the same effect can easily be achieved by utilizing hydraulic or electrical components or combinations of hydraulic, electrical and mechanical components. Further, the mechanical linkage can be in the form of a mechanism including gears and the like.

As an example, hydraulic components similar to those illustrated in U.S. Pat. No. 4,289,075 (Single Axle) issued Sept. 15, 1981, may conveniently be used. Hydraulic chambers can be used to sense changes in the angles $\theta$ and $\alpha$ between the car body portions and the frame 20. Hydraulic fluid displaced during such changes could be piped to hydraulic chambers or motors to guide the wheelsets to the desired alignment. The location of the chambers and the size of the chambers may be altered at the design stage to achieve the appropriate steering ratios dependent on vehicle parameters.

In a similar manner, electrical signals can also be generated to reflect the changes in angles $\theta$ and $\alpha$. These signals can then be used to control electric motors to guide the wheelsets as desirable.

I claim:

1. An articulated railway vehicle comprising:

first and second body portions;

a frame to which each of the car body portions is pivotally joined and supported;

first and second wheelsets pivotally affixed to said frame for supporting said frame, a third wheelset for supporting said first body portion remote from said frame, a fourth wheelset for supporting said second body portion remote from said frame, and a steering means for steering all of said wheelsets to a substantially radial alignment when said vehicle is travelling on curved track, said steering means having, first detecting means to detect changes in the angle between said frame and said first body portion, guide means responsive to said first detecting means to guide said first and third wheelsets to said radial alignment, second detecting means to detect changes in the angle between said frame and said second body portion, guide means responsive to said second detecting means to guide said second and said fourth wheelsets to said radial alignment.

2. The vehicle of claim 1 wherein said first and second detecting means and said guide means comprise mechanical linkages.

3. The device of claim 2 wherein, said fourth wheelset is pivotally linked to said first body body portion, said second wheelset is pivotally linked to said second body portion, said third wheelset is pivotally linked to said first body portion, said fourth wheelset is pivotally linked to said second body portion, said third and fourth wheelsets are pivotally linked to said frame.

4. The vehicle of claim 2, said steering means comprising:

a first link pivotally connected to said first wheelset and pivotally connected to said first body portion, a second link pivotally connected to said second wheelset and pivotally connected to said second body portion, a third link pivotally connected to said third wheelset and pivotally linked to said first body portion and pivotally linked to said frame, a fourth link pivotally connected to said fourth wheelset and pivotally linked to said second body portion and pivotally linked to said frame, so that changes in the angle between the frame and body portions when travelling on curved track are translated through said links to cause pivotal movement of said wheelsets to a radial alignment.

5. The vehicle of claim 4 wherein said third link is pivotally connected to a first bell crank and said bell crank is pivotally linked to said first body portion and pivotally linked to said frame, and wherein the fourth link is pivotally connected to a second bell crank and said bell crank is pivotally linked to said second body portion and pivotally linked to said frame.

6. The vehicle of claim 5, wherein said first bell crank is pivotally connected to said first body portion and pivotally connected to a link pivotally connected to said frame and said second bell crank is pivotally connected to said second body portion and pivotally connected to a further link pivotally connected to said frame.

7. The vehicle of claim 2 said steering means comprising:

a first link pivotally connected to said first wheelset and pivotally connected to said first body portion, a second link pivotally connected to said second wheelset and pivotally connected to said second body portion, a third link pivotally connected to said third wheelset and pivotally linked to said first body portion and pivotally linked to said first wheelset, a fourth link pivotally connected to said fourth wheelset and pivotally linked to said second body portion and pivotally linked to said second wheelset, so that changes in the angle between the frame and body portions when travelling on curved track are translated through said links to cause pivotal movement of said wheelsets to a radial alignment.

8. The vehicle of claim 7, wherein said third link is pivotally connected to a first bell crank and said bell crank is pivotally linked to said first body portion and pivotally connected to a further link and said further link is pivotally connected to said first wheelset, and wherein the fourth link is pivotally connected to a second bell crank and said bell crank is pivotally linked to said second body portion and pivotally connected to another further link and said another further link is pivotally connected to said second wheelset.

* * * * *

UNITED STATES PATENT AND TRADEMARK OFFICE

CERTIFICATE OF CORRECTION

PATENT NO. : 4,860,666

DATED : Aug. 29, 1989

INVENTOR(S) : R. Smith

It is certified that error appears in the above-identified patent and that said Letters Patent is hereby corrected as shown below:

Col. 7, claim 3, line 51, "fourth" should read --first--.

Col.7, claim 3, line 52, one of the words "body" which is repeated should be deleted.

Signed and Sealed this

Twenty-second Day of September, 1992

*Attest:*

DOUGLAS B. COMER

*Attesting Officer*

*Acting Commissioner of Patents and Trademarks*